United States Patent [19]

Cunningham

[11] Patent Number: 4,762,045

[45] Date of Patent: Aug. 9, 1988

[54] ANTI "CLICK" ELECTRONIC PICKUP DEVICE FOR STRINGED INSTRUMENTS

[76] Inventor: Julius H. Cunningham, 813 Trouville Ave., Grover City, Calif. 93433

[21] Appl. No.: 26,782

[22] Filed: Mar. 17, 1987

[51] Int. Cl.[4] ..... G10H 3/00

[52] U.S. Cl. ..... 84/1.16; 84/1.15

[58] Field of Search ..... 84/1.14, 1.15, 1.16, 84/DIG. 24

[56] References Cited

U.S. PATENT DOCUMENTS 4,142,435 3/1979 Pozar ..... 84/1.16

4,236,433 12/1980 Holland ..... 84/1.16

4,481,856 11/1984 Grawi ..... 84/1.16

4,567,805 2/1986 Clevinger ..... 84/1.16

*Primary Examiner*—Patrick R. Salce

*Assistant Examiner*—Jeffrey Sterrett

*Attorney, Agent, or Firm*—Jerry N. Lulejian

[57] ABSTRACT

An electronic pickup device for stringed instruments having a pivot securely attached to the musical instrument and one rockshaft for each string of the musical instrument. The rockshaft is attached to one end of a string and attached to the pivot so that the other end of the rockshaft vibrates in conformity with the vibrations of the string. The vibrations of the rockshaft are then translated into electrical vibrations typically via a magnet on the end of the rockshaft juxtaposed to an induction coil.

1 Claim, 2 Drawing Sheets

ANTI "CLICK" ELECTRONIC PICKUP DEVICE FOR STRINGED INSTRUMENTS

THE BACKGROUND OF THE INVENTION

The present invention relates to apparatus for aiding in the electronic reproduction of vibrations from stringed musical instruments.

The most common stringed musical instrument used today is the electric guitar. The electric guitar typically has one or two pickup coil assemblies which are mounted on the guitar body below the steel strings, adjacent to the bridge. The vibrations of the steel strings change the magnetic fields induced in the pickup coils, and, these changed magnetic fields are amplified and projected to an audience.

A well known problem with the electric guitar is that the strings often strike the metal casing of the pickup coil assembly and induce a loud, annoying and disrupting "click" in the amplified speaker system.

None of the prior art known to the applicant has addressed the problem of the strings hitting the pickup coil assembly and producing the annoying "click". Nevertheless, this problem is commonly known among musicians and there has been a long felt need for a solution to this particular problem. The present invention has solved this problem by developing a pivot and rockshaft apparatus which transfers the vibrations of the strings to a pickup coil assembly beyond the reach of the strings.

The applicant is aware of four inventions which relate to the present invention. Specifically, U.S. Pat. Nos. 4,481,856, 4,567,805, 4,236,433 and 4,142,435. None of these referenced prior art inventions relate to the present invention nor do they disclose a solution to the problem identified above and solved by the present invention.

SUMMARY OF THE INVENTION

The present invention is a device for aiding in the electronic reproduction of vibrations from strings of a stringed musical instrument. The present invention generally comprises (1) a pivot, (2) a means for securely attaching the pivot to the musical instrument, (3) a rockshaft for each string of the musical instrument and (4) a means for translating the vibrations of the rockshaft into electrical vibrations. The rockshaft is in pivoting relationship to the pivot where the first end of the rockshaft is attached to one of the strings, thus causing the vibrations from the strings to vibrate the other end of the rockshaft. The means for translating the vibrations of the rockshaft into electrical vibrations typically comprises a pickup coil which translates the mechanical vibrations of the rockshaft into electrical vibrations. In addition, the pivot and the rockshaft provide an anchoring for each string of the musical instrument.

DETAILED DESCRIPTION OF THE INVENTION

Musicians who play electric guitars and other electric stringed instruments have long been plagued with an annoying and disturbing problem. Specifically, the metal strings often impact the metal frame of the pickup coil assembly while the electric guitar is being played. This impacting on the metal case creates a loud, annoying and disrupting "click" in the speaker system when the vibrations from the electric guitar strings are amplified. This annoying "click" generally has an amplitude at least as high as any audio signal that the electric guitar can possibly play. Thus, the audience becomes particularly disturbed by the piercing amplitude and disturbing nature of the "click".

In addition, the pickup coils on the typical electric guitar are dependent on ferrous metal strings in order to pickup the vibrations from the strings. It would be of great advantage if a musician could use plastic or other non-ferrous metal strings and thus have the advantages of electronic amplification together with the variety of unique vibrations from plastic and other non-ferrous metal strings.

It would also be extremely advantageous if the device for aiding in the reproduction and amplification of the vibrations from the strings could be removeable from the musical instrument, allowing the musical instrument to be easily restored to its original configuration. Specifically, most non-electric guitars and banjos have a unique sound and it would be advantageous to electronically amplify these sounds to an audience. It would also be advantageous to have a device which could be installed on the non-electric guitar or banjo and easily removed, returning the non-electric guitar or banjo to its original configuration.

It was with this long-felt need in the musical industry and the advantages listed above that the present invention was created.

Figure 1:
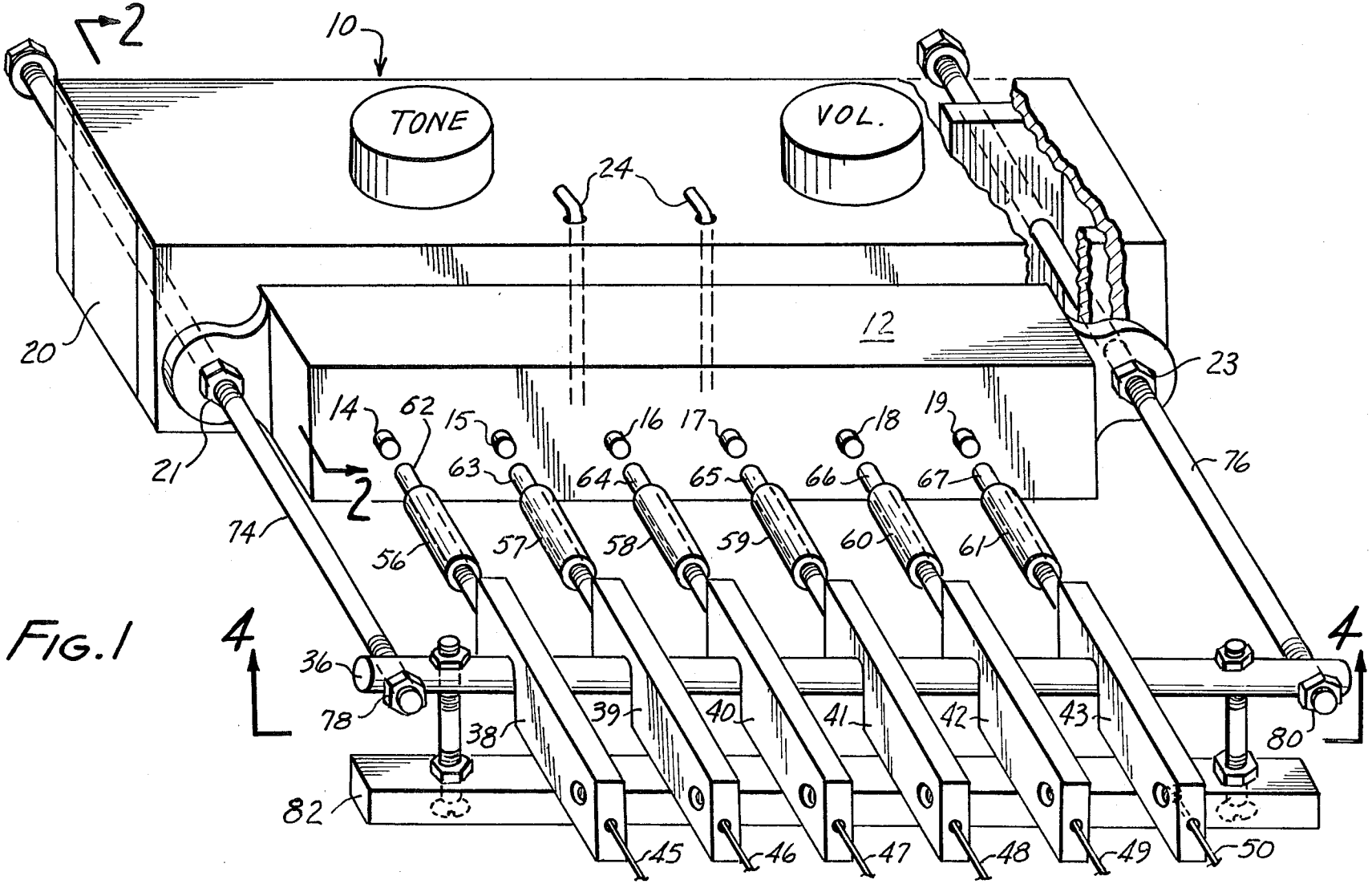
FIG. 1 is a prospective view of the present invention.

Referring to the FIG. 1, the present invention 10 typically comprises a standard pickup coil assembly 12 having pickup coils 14 through 19. The pickup coil assembly 12 is preferrably mounted to a housing 20 via bolts 74 and 76 and nuts 21 and 23.

Figure 2:
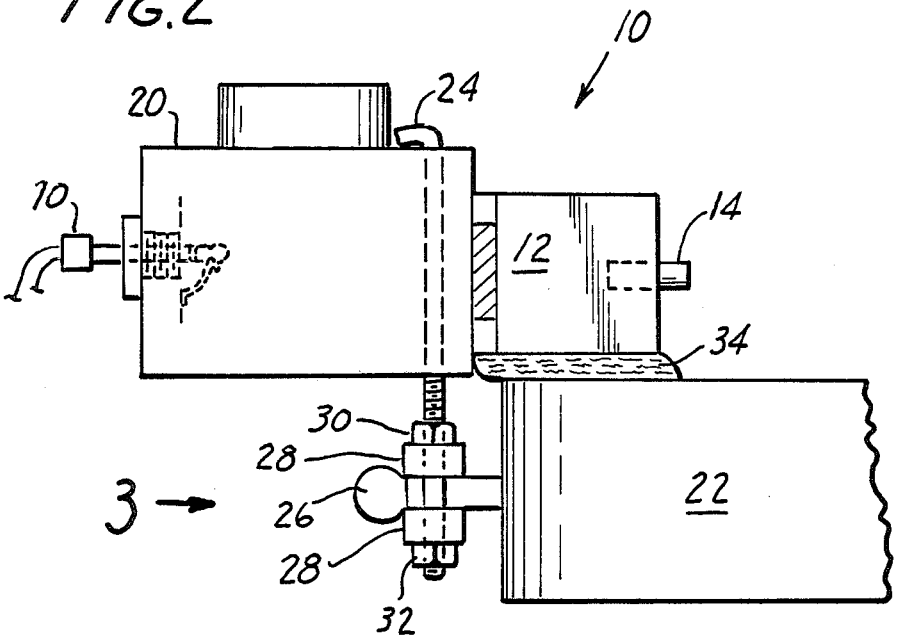
FIG. 2 is a side view of the pickup housing of the present invention mounted on a banjo.
Figure 3:
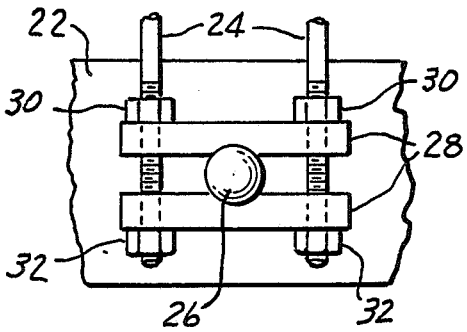
FIG. 3 is a elevational view of the means for securely attaching the pivot to the banjo.

Referring now to FIGS. 1 and 2, the housing 20 is typically securely fastened to the musical instrument 22 (shown here as a banjo) via clamping members 24 attached to the rear abutment 26 of the musical instrument 22 via cross bars 28 and locking nuts 30 and 32.

Referring specifically to FIG. 2 a pad 34 of some soft material such as foam rubber is placed underneath the pickup coil assembly 12 in order to prevent scratching of the musical instrument 22. The housing 20 is preferrably made of sheet metal and formed as shown.

With the housing 20 and its associated pickup coil assembly 12 firmly mounted to the musical instrument 22, the present invention 10 further comprises a pivot 36 and rockshafts 38 through 43. The pivot 36 and rockshafts 38 through 43 are preferrably composed of steel or other rigid material.

Figure 5:
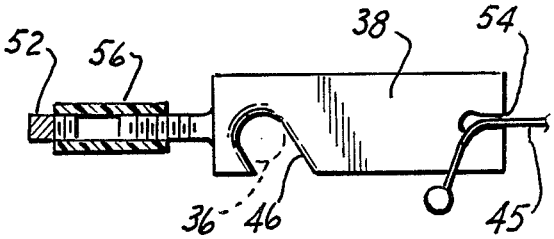
FIG. 5 is a side elevational view of the rockshaft of the present invention.
Figure 4:
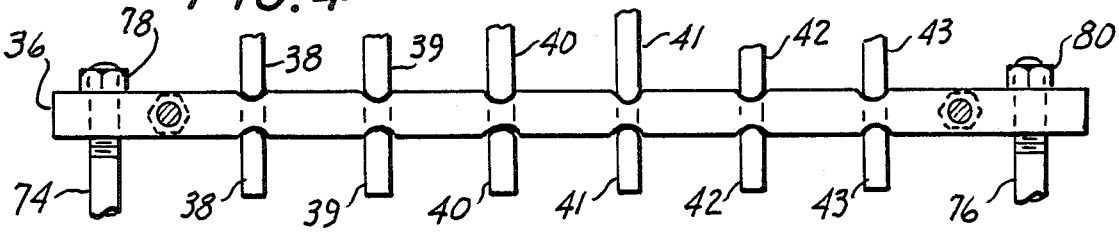
FIG. 4 is a view along line 4—4 of the pivot of the present invention.

Referring specifically to FIGS. 2, 4 and 5 the rockshafts 38 through 43 have a cut groove 40 (shown only in FIG. 5) therein which fits over the pivot 36. Thus, each rockshaft 38 through 43 is in pivoting relationship to the pivot 36 (shown more specifically in FIG. 1). The strings 45 through 50 are interconnected to one end of the rockshafts 38 through 43, respectively. Preferably, the interconnection can be done by placing a ball 52 on the end of each string 45 through 50 and interfitting the ball 52 within a chamber 54 (FIG. 5) which will not allow the string to pull away from the rockshafts 38 through 43. The other end of the rockshafts 38 through 43 are preferrably threaded and have placed thereon threaded stays 56 through 61. Each stay 56 through 61 is preferrably made of an electrically insulating material with magnets 62 through 67 attached to one end. The stays 56 through 61 may be of polystyrene tubing. The insulating effect of the stays 56 through 61 prevent the musician's hand and body from influencing the magnetic fields around the pickups 14 through 19.

Thus, the pivot 36 and the rockshafts 38 through 43 provide an anchor for the strings 45 through 50. In addition, the vibrations from the strings 45 through 50 cause the end of the rockshafts 38 through 43 containing the stays 56 through 61 and their associated magnets 62 through 67 to vibrate about pivot 36. The vibration of rockshafts 38 through 43 and the magnets 63 through 67 attached thereto create varying electrical currents in the pickups 14 through 19 of the pickup coil assembly 12. These varying electrical currents are then sent to the amplifying device (not shown) preferrably via cable 70. These electrical currents are then amplified and presented to the audience via a speaker system (not shown).

The pivot 36 is preferrably mounted to the housing 20 via bolts 74 and 76 and nuts 78 and 80. Thus, the pivot 36 is prevented from moving and detuning the strings 45 through 50. Bolts 74 and 76 are further supported by cross support 82 which rests on the musical instrument 22. The cross support 82 is preferrably made of wood.

Thus, the present invention has achieved the following advantages: (1) the strings 45 through 50 cannot create the annoying "click" no matter how hard they are plucked, (2) the present invention 10 is detachable without damages to the musical instrument 22 and (3) any sort of strings 45 through 50 can be used successfully with the present invention 10.

The preceding disclosure of the preferred embodiment present invention is for illustrative purposes only and shall not be considered to define the scope of the present invention. Instead, the scope of the present invention shall be defined by the following claims and their equivalents.

I claim:

1. In a stringed musical instrument having at least one string, each string having two ends, a device for aiding in the electronic reproduction of vibrations from the at least one string comprising:

a pivot;

a means for securely attaching the pivot to the musical instrument;

at least one rockshaft, each rockshaft in pivoting relationship to the pivot, each rockshaft having a first and second end, the first end being attached to one of the at least one string so that vibrations of the at least one string cause the second end to vibrate;

the pivot and the at least one rockshaft anchoring one end of at least one string; and, a means for translating the vibrations of the second end of each rockshaft into electrical vibrations.

* * * * *